US006796813B1

(12) United States Patent
L'Hermet

(10) Patent No.: US 6,796,813 B1
(45) Date of Patent: Sep. 28, 2004

(54) DATA STORAGE OR RECORDING DEVICE AND PROCESS FOR HERMETICALLY CONNECTING A DATA RECORDING AND STORAGE CARTRIDGE AND RECEPTACLE

(75) Inventor: Jean-Louis L'Hermet, Clamart (FR)

(73) Assignee: Enertec S.A. (FR)

( * ) Notice: Subject to any disclaimer, the term of this patent is extended or adjusted under 35 U.S.C. 154(b) by 0 days.

(21) Appl. No.: 09/588,728

(22) Filed: Jun. 7, 2000

(30) Foreign Application Priority Data

Jun. 7, 1999 (FR) ..... 99 07306

(51) Int. Cl.[7] ..... H01R 13/44; H01R 13/60; H01R 4/50; H01R 13/625

(52) U.S. Cl. ..... 439/131; 439/341

(58) Field of Search ..... 439/341, 376, 439/289, 246; 365/52; 361/728

(56) References Cited

U.S. PATENT DOCUMENTS 4,602,351 A * 7/1986 Shimamura et al. ..... 235/441
4,872,139 A 10/1989 Okamoto et al.
5,004,583 A * 4/1991 Guruswamy et al. ..... 204/401
5,043,562 A 8/1991 Hautvast et al.
5,302,136 A * 4/1994 St. Germain et al. ..... 439/341
5,486,982 A * 1/1996 Hsu ..... 361/728
5,760,465 A * 6/1998 Alcoe et al. ..... 257/669
5,979,242 A * 11/1999 Hobbs ..... 73/663
6,035,664 A * 3/2000 Hashizume ..... 385/92
6,135,783 A * 10/2000 Rathburn ..... 439/66

FOREIGN PATENT DOCUMENTS

EP 0 616 394 A1 9/1994
EP 0 924 972 A2 6/1999
EP 0 924 972 A3 12/1999

OTHER PUBLICATIONS

"Replaceable Card Cartridge For Equipment Enclosure", IBM Technical Disclosure Bulletin, Mar. 31 (1989), No. 10, Armonk, NY, US.

* cited by examiner

*Primary Examiner*—Chandrika Prasad
(74) *Attorney, Agent, or Firm*—Arent Fox, PLLC

(57) ABSTRACT

The invention is data recording (and storage) device for use in a severe environment. A connection is made between a cartridge 40 comprising a data recording and storage means on its receptacle 30 by contact and not by insertion, and the contact is made for each electrical contact by the cooperation of a plug 10, mounted elastically by a means 11 on receptacle 30 and a stud 12, 16 or 18 mounted on cartridge 40. The invention also comprises a process for cartridge-receptacle engagement which ensures self-cleaning of contacts. The device is intended for use on airliners, combat aircraft, ships, helicopters, combat vehicles such as, for example, armored vehicles, spacecraft and similar equipment.

38 Claims, 7 Drawing Sheets

DATA STORAGE OR RECORDING DEVICE AND PROCESS FOR HERMETICALLY CONNECTING A DATA RECORDING AND STORAGE CARTRIDGE AND RECEPTACLE

This application claims the priority of French Application No. 99-08306 filed Jun. 7, 1999.

BACKGROUND OF THE INVENTION

1. Field of the Invention

This invention relates to devices for data recording (and storage) in a severe environment. In a particular, but non-limiting example, it pertains to devices intended to equip airplanes; combat aircraft; ships; helicopters; combat vehicles, for example, armored vehicles; spacecraft; and similar equipment.

This invention relates to the storage and recording of all types of data, for example, numerical, audio and especially video data, and includes types of data that may appear in the future.

2. Background

In this general context, storage and recording on magnetic tape is included, but, in a preferred embodiment, data storage and recording is in a "cartridge," that is to say, a hermetically sealed box, for example, a hard disk with its reading and recording device, comprising an "arm" in the conventional fashion.

Hard disks, as used herein, include those that are currently available, especially disks with a format of 22" or 32", as usual, or any other hard disk or similar system that could appear in the future.

As persons skilled in the art will understand, the invention also applies to any other data storage and recording support that is contained in a box that must be hermetically sealed and that must be handled so as to be extracted from its housing after a given mission or operation and that must then be reinserted in that same housing for the next mission or operation.

Also included within the scope of such devices are semiconductor memories and any other technology having an equivalent, current or future function.

"Hermetic" means here the vacuum-tight elements, that is to say, those that have a zero or extremely low leakage rate in a vacuum environment or under very low ambient pressure.

"Tight" means watertight or humidity-tight elements.

In the above-mentioned environments, the equipment is typically subject to difficult or extreme conditions of vibration, vacuum (altitude) and/or shocks and similar constraints.

The most difficult problem to be solved is the problem of altitude and, the more or less forceful pressure drop to which the equipment will be subjected.

Pressure differences, when exerted on a non-hermetic device, will bring about incoming and outgoing flows of atmosphere in the box containing the data device and hence produce condensation phenomena. Moreover, in the case where the cartridge contains a hard disk, the arm will not remain at a predetermined distance from the disk, called the aerodynamic distance, but will risk being placed on the disk and scratching it, resulting in deteriorated recordings.

It is thus necessary to resort to hermetically sealed boxes and boxes that are generally "suspended," that is to say, they are mounted on shock absorbers capable of reducing the shocks and vibrations undergone in the severe environments to acceptable values.

Data devices must also have a sufficient number of electrical contacts between the box (cartridge) and its support (receptacle) in the recorder to ensure the necessary transmissions of signals.

For example, according to the currently customary data processing standards, one must have about 50 contacts for the IDE standard and 80 for the SCSI standard.

However, recorders, especially those mounted in aircraft, must have as small dimensions as possible for obvious reasons of weight and bulk and, thus, the surface area available for contacts is reduced. This means that the contacts must themselves have small dimensions.

Another requirement is that contacts must, without any harmful wear and tear, withstand a large number of "insertions," that is to say, connection/disconnection cycles, without displaying any wear and tear that would induce parasite resistances that would affect the data. Military-type connectors, such as the SUB-D or HILC 38999 type, can withstand 200 to 400 insertions. The chip card connectors must withstand about 5,000 insertions.

It is also absolutely necessary that the cartridges be easily handled, that is to say, they must be easily extracted, transported and put back in place without any special precautions nor any special tools, even in a hostile or difficult environment. Thus, the boxes must be capable of being handled by technicians at airport runways, possibly with hands wearing thick gloves, and they must withstand shocks, such as those that result from being dropped, and similar trauma encountered in routine use.

The devices must therefore be compact, light, sturdy, hermetic, easily handled, and, obviously, reliable. They must present a large number of contacts on as small a surface as possibly and they must be capable of withstanding a large number of insertion cycles, for example, on the order of 3,000, without any damaging wear and tear. They must present an extraction and engagement mechanism that itself must be compact, simple, sturdy, reliable, and very precise, especially in terms of electrical contacts, that also must be easily handled, including with gloves. Insertion and extraction must not require any excessive force (entailing the risk of damaging the shock absorbers). The simple listing of these objectives underscores the difficulty of this undertaking because persons skilled in the art will understand that practically all of these criteria are antagonistic.

There is no currently available connector capable of meeting all of these criteria. The only connectors that come close to some of these parameters are connectors for memory cards, but they are infinitely too fragile and absolutely unsuitable for the environments contemplated for the invention.

Connectors called "hermetic lead-through" of the type shown in FIG. 1, are currently known.

BRIEF DESCRIPTION OF THE DRAWINGS

Other features and advantages of the invention will appear more clearly upon reading the following description and referring to the attached drawing where.

Figure 1:
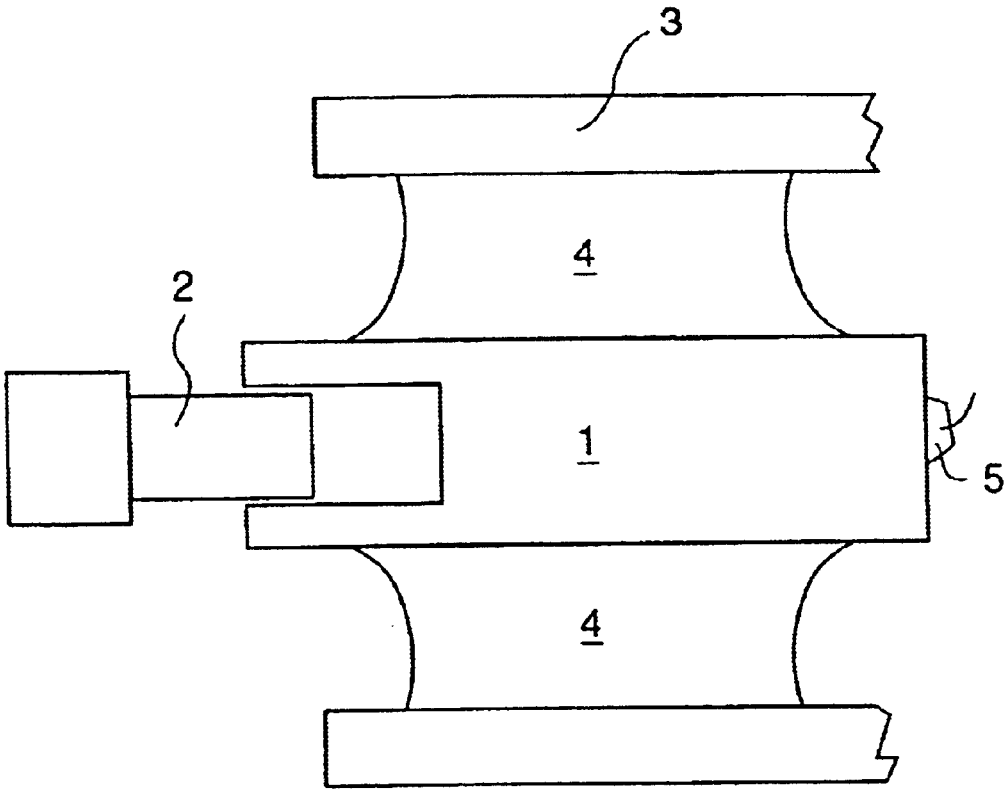
FIG. 1 shows a "hermetic lead-through" contact of the prior art.

On the attached figures, the same references have the same meanings, to wit:

1 female contact (prior art)
2 male contact or "plug" (prior art)
3 metallic support or "case" (prior art)
4 hermetic glass welding (prior art)
5 rear connection of contact, especially toward a printed circuit board not shown
10 elastic "plug"-type contact of the spring or piston type according to the invention
11 base of spring plug for mounting on printed circuit in nonrestrictive examples shown
12 contact of "stud" type according to the invention, intended to cooperate with elastic plug 10
16 variant of shape of stud 12 according to the invention
18 other variant of shape of stud 12 according to the invention
30 support or "receptacle" of cartridge, incorporating a connection plate 95, comprising plug contacts 10
40 cartridge (face bearing connection with "studs" 12 (or 16 or 18 or other variants within the immediate reach of persons skilled in the art)
45 connection rod for stud 12 (or 16 or 18 or other variants within the immediate reach of persons skilled in the art)
46 stud head
47 stud covering (generally a thin layer of gold)
60 stud protection layer (generally resin)
70 closing hood of box (opening according to arrow (1))
75 "prismatic" piece or cam integral with hood
80 rod or other control piece
85 mechanical safety unit (containing a return spring)
87 axis of rotation along arrows (2) and (3) when the hood is open
(M1) shock and vibration absorption movements of receptacle 30 (only movements perpendicular to the faces of the receptacle are considered here)
90 retractable chock:
closing hood 70 of box 200 closed: chock in high position permitting movements (M1) of receptacle 30; hood open: chock in low position blocking movements (M1);
100 engaging clip of cartridge 40
105 groove for fitting or clipping protuberance 120, preferably semi-cylindrical
110 piece for engagement of receptacle 40 of cartridge and support of protuberance 120, which is a cylindrical pin in preferred embodiment of the invention
120 protuberance intended to cooperate with groove 105, which protuberance is a cylindrical pin in a preferred embodiment of the invention
140 "U"-shaped piece, support of protuberance 120, which protuberance is a cylindrical pin in a preferred embodiment of the invention, the "U"-shaped piece 140 being adapted to receive clip 100 and cooperate with it and especially with groove 105
200 box
300 shock absorber of receptacle (generally a three-dimensional shock absorber)
400 Spring or return means

SUMMARY OF THE INVENTION

In the prior art, illustrated in FIG. 1, to make a single contact, it is necessary to provide a plug 2, cooperating with a female contact 1 (or inversely), the female member having to guide the plug. The assembly is maintained in a support or "case" 3 by means of a hermetic joint 4 formed by a glass welding, that is to say, a hermetic joint obtained by heating the assembly in the known fashion to about 600–700° C. until the glass forms a semi-liquid phase, bringing about a tight vacuum ("hermetic") connection upon cooling. The plug 2 and the female contact 1 each are connected to a standard connection device such as a printed circuit or similar device, for example, at 5. The plugs have a screwing button that applies a strong insertion or extraction force on the contacts along the longitudinal axis of the connection. Such a force is not compatible with the requirements of the invention according to which the necessary connection force must be weak to facilitate handling and, above all, not to damage the shock absorption systems. In the devices shown by this invention, the masses, suspended by the shock absorption means, are light and consequently the shock absorbers are flexible; an excessively strong force would damage them irreparably and the device could no longer be suitably suspended, with serious consequences as regards the reliability of measures and the system. Such known devices, furthermore, have very large dimensions with diameters on the order of a 3 to 5 cm housing with about 40 contacts. Furthermore, they do not make it possible to mechanically lock the cartridge. For these various reasons, their so-called "insertion" technology is not suitable.

The invention proposes a solution that is not an insertion but rather a "contact" in spite of the contradictory requirements mentioned above.

Generally speaking, the invention relates to a process for making a connection between a cartridge 40, that includes a data recording and storage means, and a receptacle 30, characterized in that the connection is made by contact and not by insertion and that the contact is made for each electrical contact by the cooperation of a plug 10 mounted elastically by a means 11 on receptacle 30 and a stud 12, 16 or 18 mounted on cartridge 40.

The advantage inherent in the contact technology is that it eliminates the constraint represented by precision axial guidance that is required in case of insertion as in FIG. 1.

The solution is not obvious because it was also recalled that the problem posed here, among other things, was to provide a light and compact system not requiring a strong cartridge insertion or extraction force and easily handled with gloved hands or the like.

According to the invention, we propose quite generally a data storage or recording device for a severe environment that can possibly be mounted on land vehicles or on ships or aircraft or space vehicles of any type the device of the invention includes a recording cartridge (with hard disk or other data support) and a receptacle (or cartridge support) that is "suspended" (that is to say, it is kept in position by preferably multidirectional shock absorbers), characterized in that the connection between the cartridge and its receptacle is made by contact and not by insertion and that the contact for each electrical contact is made by the cooperation of a plug mounted elastically on the receptacle and a stud mounted on the cartridge in a hermetic manner.

DETAILED DESCRIPTION OF THE INVENTION

The invention is a data storage or recording device for use in a severe environment that can be mounted on land vehicles or on ships or aircraft or space vehicles of any type. The device includes a recording cartridge 40 (with hard disk or other data support) and a receptacle (or cartridge support) 30 that is "suspended" (that is to say, it is kept in position by preferably multidirectional shock absorbers). The connection between the cartridge and its receptacle is made by contact and not by insertion and the contact for each electrical contact is made by the cooperation of a plug 10, mounted elastically with means 11 (such as a spring or on the a piston receptacle), and a stud 12, 16 or 18 mounted on the cartridge 40 in a hermetic manner.

The invention provides a solution that accommodates all of the required parameters of a data storage or recording device for a severe environment that can be mounted on a land vehicle or a ship or an aircraft or a space vehicle, where the device is of the kind that includes a recording cartridge 40 (with hard disk or other data support) and a receptacle (or cartridge support) 30 that is "suspended" (that is to say, it is kept in position by preferably multidirectional shock absorbers). The device is characterized in that:

- the connection between recording cartridge 40 and suspended receptacle 30 is made by as many couples of plug 10/stud 12 or 16 or 18 as there are required contacts;
- the plugs 10 go through the wall of receptacle 30 and present a protuberant portion with a spherical, rounded or similar shape;
- the plugs 10 are mounted by a shock absorption and return means 11;
- the studs 12 or 16 or 18 go through the wall of the cartridge 40 and present a slightly protuberant part with a convex shape 12, with a plan or shape 16 or with a slightly concave shape 18;
- the plugs 10 and the studs 12 or 16 or 18 are geometrically adapted in terms of shape and dimension to cooperate and create an effective electrical contact when one makes receptacle 30 and cartridge 40 face each other;
- the cartridge 40 and the receptacle 30 include an engagement means capable of positioning all such plugs 10 and studs 12, 16, 18 opposite each other so as to make an effective electrical contact and to ensure the mechanical hold of cartridge 40.

Persons skilled in the art will understand that the shape of the plugs and the studs is not restrictive here and is given only way of illustration. Preferred plugs have a head with a generally spherical or rounded shape at the top 46. Studs having a head that is slightly convex 12 are preferred; studs may also have a flat head 16 or a slightly concave head 18.

Generally speaking, persons skilled in the art will know how to visualize—if necessary, by means of routine tests—the adapted shapes to create an effective electrical contact by means of contact.

As used herein, the terms "plug" and "studs" are intended to designate all of these shapes either described here or accessible to persons skilled in the art.

Figure 2:
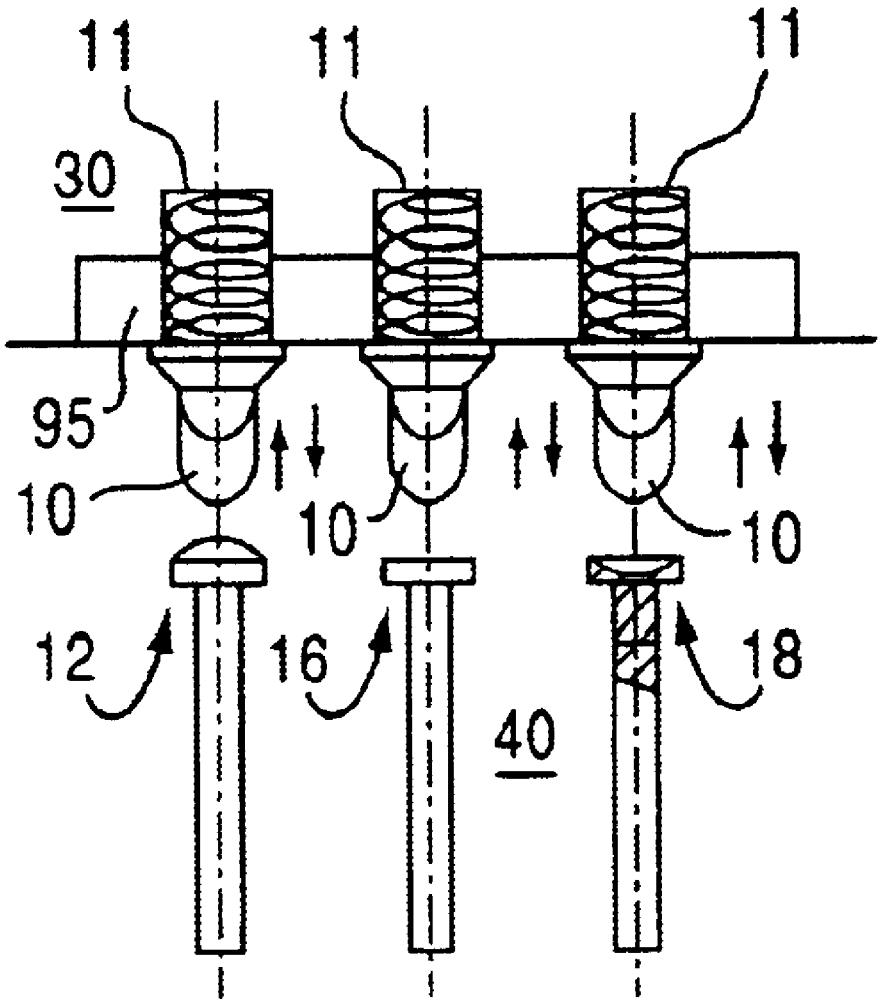
FIG. 2 shows three nonrestrictive examples of couples of plugs and studs forming the connection according to the invention.
Figure 5:
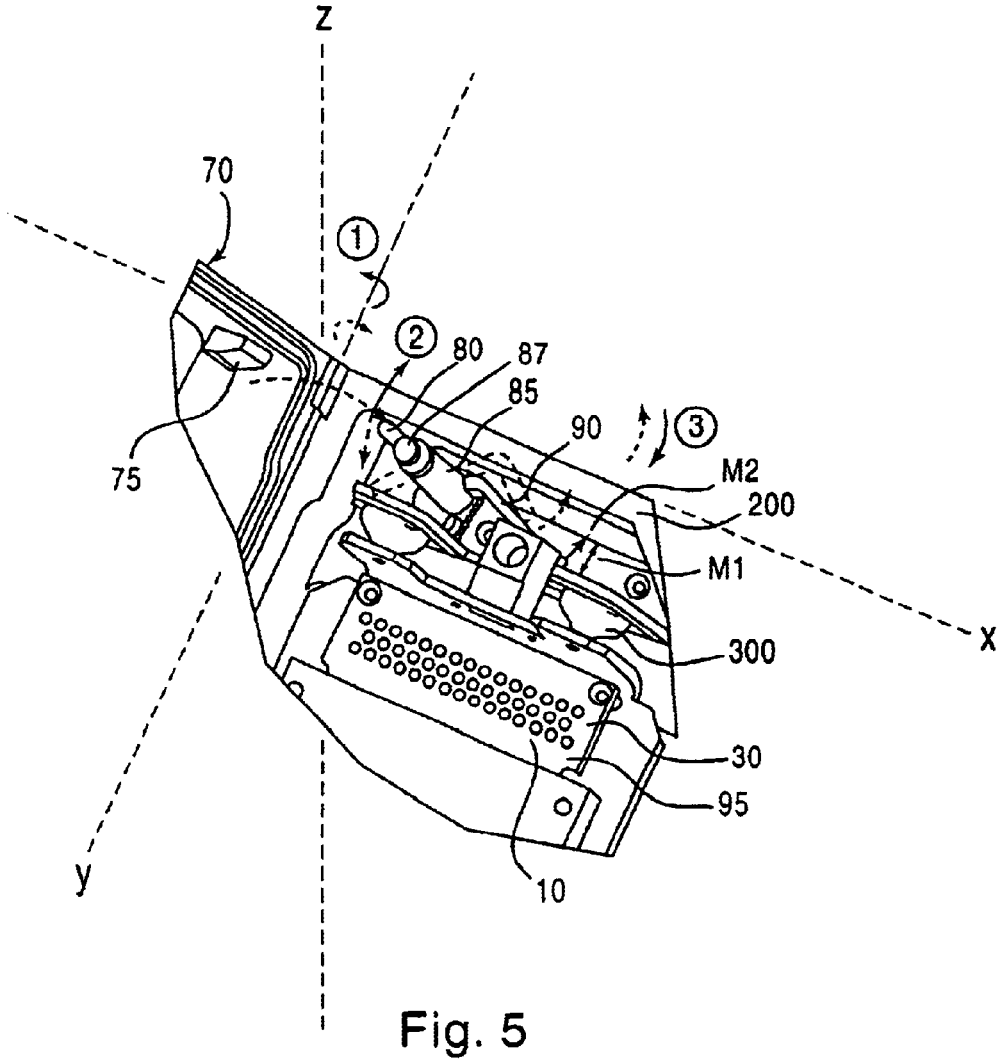
FIG. 5 illustrates a way for locking the shock absorption of a receptacle in a box.

As shown in FIG. 2 and FIG. 5, the plugs (and, respectively, the studs) will preferably be positioned in a plate 95 of the receptacle 30 (or, respectively, of the contact face of the cartridge 40). One could provide other devices that have, for example, several zones of studs and plugs opposite each other, and these and similar arrangements are within the knowledge of persons skilled in the art.

Figure 4:
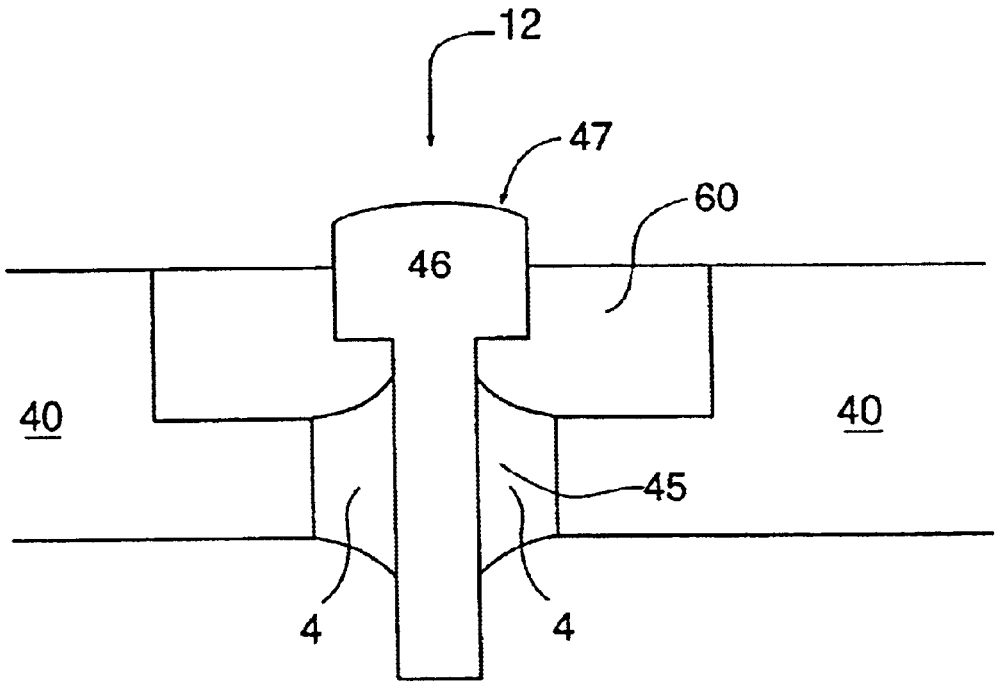
FIG. 4 illustrates a way of mounting a stud in the wall of a cartridge 40 according to the invention.

FIG. 4 shows a preferred manner of mounting the studs in the wall or contact face of the cartridge 40.

Accordingly, the invention also relates to a process for mounting the studs according to which stud 12 (or 16 or 18) is positioned by its rod 45 in an adaptive opening in a wall of the cartridge 40 by means of a glass welding 4 after which a mold of protective material 60, such as a resin, is deposited around the head 46.

The stud will preferably be made of metal or an alloy with a very high electric conductivity and it will preferably comprise a fine gold coating 47 or a coating of an equivalent metal or alloy promoting electrical contact between the plug and the stud.

As noted earlier, the cartridge 40 is intended to be removed from its support or receptacle 30, for example, upon return from a mission, so that its contents may be processed. The cartridge 40 must then be capable of being repositioned in the its receptacle 30 for the next mission, with as perfect an electrical contact as possible.

The solution to the problems in the prior art is not evident because it is advisable perfectly to position the connection arrangement whose contact surface is very small for each plug/stud couple.

The invention works via engagement/disengagement, performing a complex movement described below.

Figure 3:
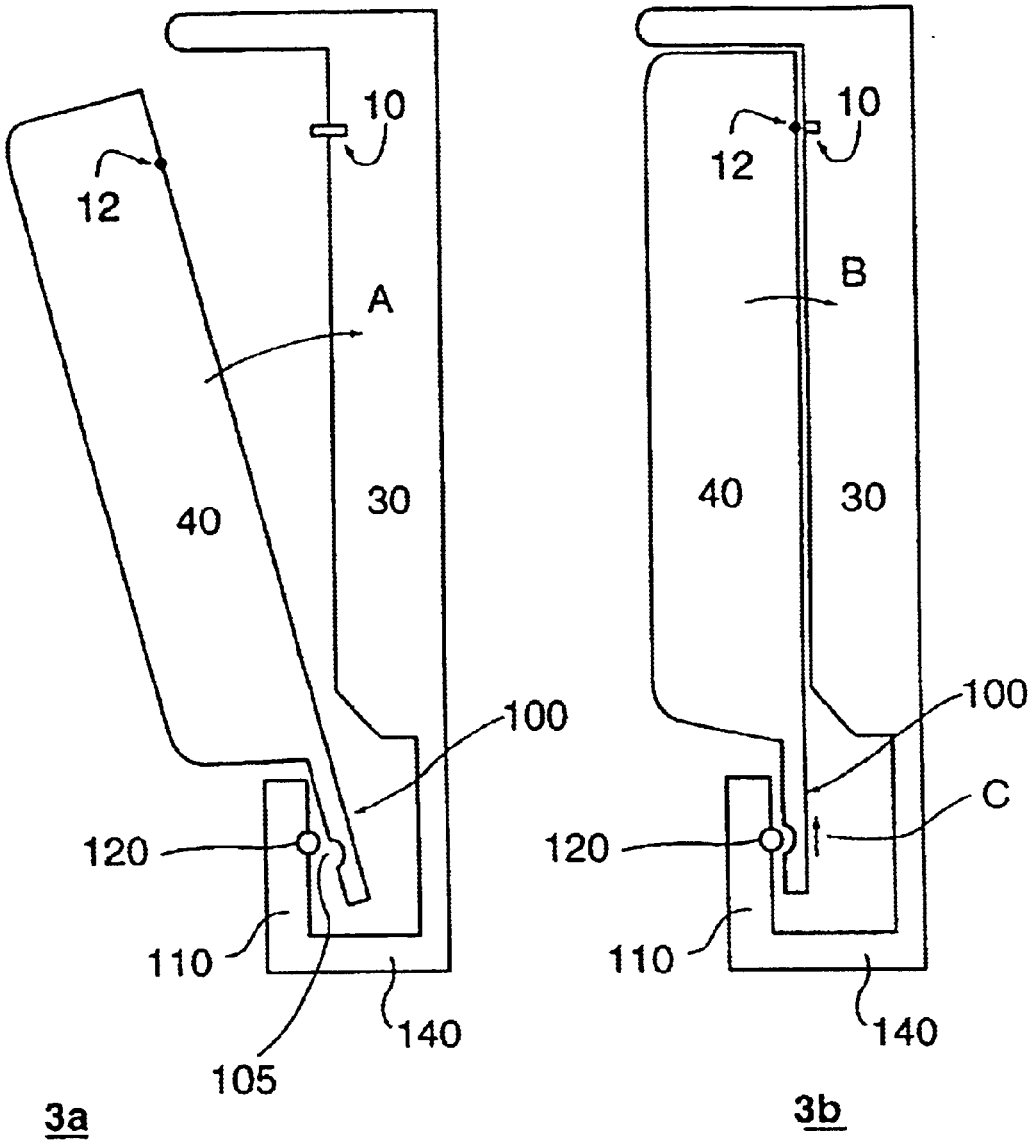
FIG. 3 illustrates the process of engaging a cartridge in a receptacle.
Figure 7:
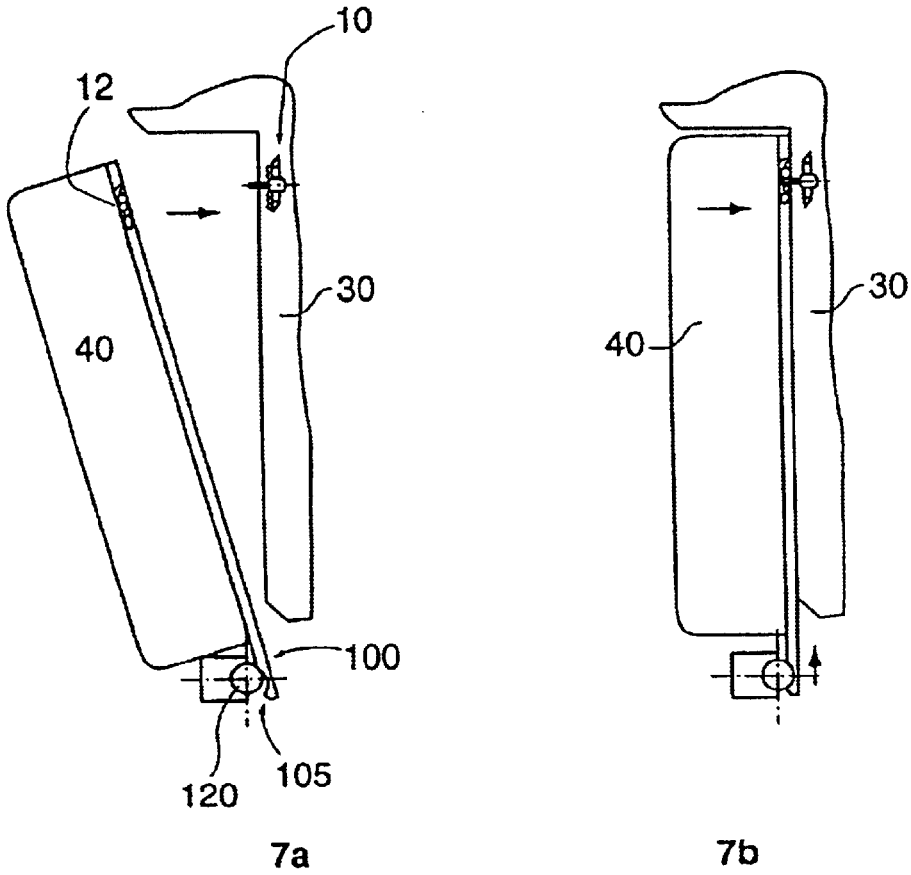
FIG. 7 illustrates an engagement process according to the invention.

FIG. 3 and FIG. 7 illustrate examples of processes for engaging the cartridge in the receptacle.

FIG. 3*a* (and FIG. 7*a*), show the position of the cartridge 40 and receptacle 30 (or cartridge support), just prior to engagement. One can see that cartridge 40 has, integral with its lower portion, at least one and preferably at least two clips 100 having a groove 105. The clips 100 are capable of cooperating by tight fitting with a protuberant part 120 that is integral with an engagement piece 110, 140 in the shape of a "U," which is itself integral with the receptacle 30. Cooperation between the receptacle 30 and cartridge 40 is governed by mechanical means such as the engagement movement of the clip, or clips 100 in the "U" shaped engagement piece 110, 140, leading to "pre-engagement", by a slightly exaggerated descent of the clip of the cartridge with respect to protuberance 120 followed by "final engagement" through the fact that said clip is raised again to lead to a tight fit of the groove 105 and the protuberance 120.

The engagement process involves assisting the engaging action by making the clip or clips 100 slide (movement "A," FIG. 3*a*) in the "U" opening of engagement piece 110, 140, seeing to it that groove 105 will descend slightly further down that the corresponding protuberance 120 (FIGS. 3*a* and 7*a*) after which one ends the engaging action by putting the contact face of cartridge 40 on the contact face of receptacle 30 (movement "B," FIG. 3*b*,) and by allowing the two faces to be positioned via a slight rise (movement "C," FIG. 3*b*) and by tight fitting of groove 105 with protuberance 120 at the end of this rising motion.

According to the preferred embodiment of the invention, protuberance 120 is a cylindrical pin and corresponding groove 105 is a semi-cylindrical groove so adapted as to receive the pin 120 with a tight fit. With the help of this term, persons skilled in the art will understand that there is no leeway after engagement.

Figure 6:
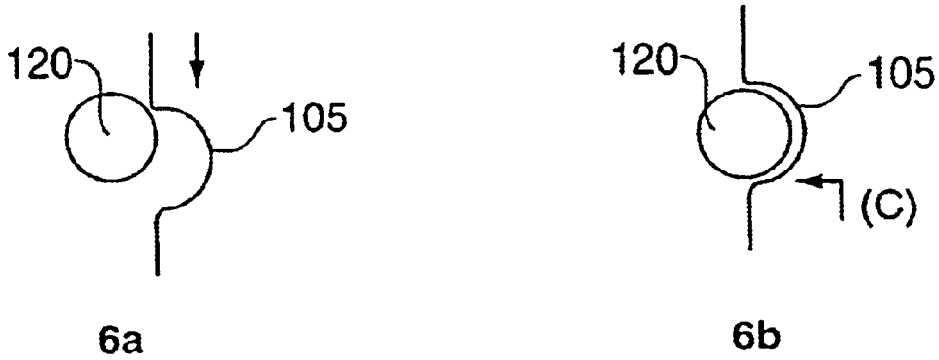
FIG. 6 illustrates method used in engaging the pin 120 in sleeve 105 according to the preferred embodiment of the invention.

FIG. 6 illustrates a method of engaging the pin in the groove.

During the above-described engagement action, cylindrical pin 120 initially rests on the edge of groove 105. (FIG. 6*a*) The compression effort that is applied when the cartridge compresses the plugs causes the pin 120 to roll into the center of the groove 105. (FIG. 6*b*).

According to this process, one understands that the slight rise of the cartridge during final engagement, which represents an extremely small distance of about 0.2 to 0.5 mm while each stud comes into contact with each plug, will be expressed by a perfect self-cleaning of the contact surfaces. During this movement, there is no wear and tear that one might fear and that would be damaging; tests showed, on the other hand, that the effective service life of contacts thus self-cleaned was definitely longer than the effective service life of the cartridge.

As also indicated above, it is important that the operator not be forced during the placement of cartridge 40 to apply excessive forces on receptacle 30 that could damage the shock absorbers.

We know that the device made up of the receptacle 30 and the cartridge 40, as well as by various other known elements, are generally contained in a resistant and tight box. FIG. 5 shows the positioning of a receptacle 30 in a box 200. One gets at the receptacle by opening a hood 70.

The invention proposes the device include a mechanical means consisting of, e.g. a cam (75) and a retractable chock (90), for the temporary automatic locking of the receptacle 30 to protect the shock absorbers 300 during the extraction phase and the phase in which a cartridge is put back in the receptacle.

With reference to FIG. 5, a preferred solution for use in the invention is a device that includes a mechanical means for the temporary and automatic locking of receptacle 30 when one opens a hood 70 of the box 200 to gain access to the cartridge, and the same means again permits the normal spring-back shift (M2) of receptacle 30 during the closing of the hood to, that is to say, after one has put a cartridge back in place by means of engagement on the receptacle.

The importance of locking the shift is that one protects the shock absorbers 300 since they—regardless of the force that is exerted—are no longer stressed along direction of the shift (M2).

FIG. 5 shows a particular nonrestrictive means for temporary locking, characterized in that it includes a prismatic piece or a cam 75 having an inclined face that is integral with the hood 70 and a retractable chock 90 that is integral with a piece 85 constituting the mechanical safety unit considered. The piece is integral with a control rod 80 or a similar piece capable of cooperating with the cam 75 via contact by sliding on the inclined surface of the cam or prism. The entire piece forming the chock is mounted in a rotating manner around the longitudinal axis 87 of unit 85. The unit 85 includes a return means such as a spring or a similar device, tending to lower the chock 90 behind the contact face of receptacle 30 and the various geometries, shapes and positioning of the various pieces are adapted so that the opening of the hood 70 (and thus of cam 75) according to movement (1) by rotating relative to a y axis would release control rod 80, which then moves due to the action of the return means, not shown, according to a rotating movement (2) along an x axis to which corresponds a rotating movement (3) of chock 90 relative to a z axis, a movement that positions the chock 90 behind the receptacle 30. The thickness and positioning of chock 90 are adapted so that in this position the shock absorption (or spring release shift) movement (M1) in a linear direction along the y axis of the receptacle will be impossible.

One can then return the cartridge in place without the receptacle contacting the shock absorbers 300 according to movement (M1), since that movement is prevented by chock 90 and there is therefore no risk of deforming the shock absorbers 300.

When one doses the hood again, the inverse movement raises chock 90, which is then positioned above the receptacle, thus again permitting shock absorption movement (M1).

According to a nonrestrictive embodiment of the invention, the return force for plugs 10 is on the order of 1 N for each plug.

According to a preferred but nonrestrictive embodiment, the shock absorption or return means 11 for plug 10 is a spring or a piston, preferably a small piston.

The system described in FIG. 5 can also be used as a detector for the opening of the hood 70. It is necessary that the cartridge no longer be connected to the power supply when one extracts it. For example, when the cartridge, comprises a disk and an arm, the arm could stop and rest on the disk; one can easily understand that the further movements imparted to the cartridge during its transport will be transmitted to the arm, which will damage the disk and the recorded data. On the other hand, if the power supply to the cartridge is cut off prior to extraction, the arm is automatically placed in the so-called "parking" position where it cannot damage the disk.

The system in FIG. 5, according to a particular embodiment, comprises a means adapted for automatically cutting the electric power supply to the cartridge when hood 70 is opened.

Such a means, may be for example, an opening detection contact of the known type, mounted partly on the hood and partly on the portion of the box containing cartridge receptacle 30.

Persons skilled in the art will know how to visualize other equivalent means.

The invention also relates to applications of devices and processes described for recording and storage of data on the ground or mounted on a land vehicle or a ship or an aircraft or a space vehicle of any type.

What is claimed is:

1. A data storage or recording device suitable for use in a severe environment, comprising a cartridge having a stud hermetically mounted on the cartridge and a receptacle having a plug, wherein, the cartridge is engageable in the receptacle, the receptacle is suspended by a shock absorber mounted in a box with a hood, and when engaged, the cartridge and the receptacle are electrically connected by the cooperation of the plug and the stud, said plug and said stud being connected by point contact and without lateral contact, wherein opening the hood disengages the shock absorber by engaging a means for temporarily and automatically locking the movement of the receptacle.

2. The device of claim 1, wherein the cartridge (40) comprises a data support.

3. The device of claim 2, wherein the data support is a hard disk.

4. The device of claim 1, wherein the receptacle is suspended by multidirectional shock absorbers.

5. The device of claim 1, comprising a plurality of plug and stud pairs, each plug and stud pair corresponding to one electrical contact between the cartridge and the receptacle.

6. The device of claim 1, wherein the studs have a surface shape selected from concave, planar and convex.

7. The device of claim 1, wherein the plugs (10) have a head with a rounded shape at the top.

8. The device of claim 1, further comprising a cushioning means (11), wherein the plugs are mounted elastically on the receptacle (30) by the cushioning means.

9. The device of claim 8, wherein the cushioning means (11) comprises a spring or a piston.

10. The device of claim 1, wherein the plug is positioned in a plate (95) on the receptacle (30).

11. The device of claim 1, wherein the stud is positioned in a plate (95) on the cartridge (40).

12. The device of claim 1, comprising several zones of corresponding plugs and studs that are opposite each other when the cartridge is engaged in the receptacle.

13. The device of claim 1, wherein the stud comprises a rod (45), the stud being mounted and positioned by said rod in an opening in a wall of the cartridge (40) by glass welding (4).

14. The device of claim 13, further comprising a mold of protective material (60) deposited around a head (46) of the stud.

15. The device of claim 14, wherein the protective material comprises a resin.

16. The device of claim 1, wherein the stud comprises a metal or an electrically-conducting alloy.

17. The device of claim 1, further comprising a metal coating on the stud.

18. The device of claim 17, wherein the metal coating comprises gold.

19. The device of claim 1, wherein the cartridge (40) further comprises an integral clip (100), said clip comprising a groove (105) and wherein the receptacle (30) further comprises a protuberant part (120) that is integral with a U-shaped engagement piece (110, 140) which is integral with the receptacle (30), said groove and said protuberant part cooperating to form a tight fit when the cartridge is engaged in the receptacle.

20. The device of claim 19, wherein the clip engages the U-shaped engagement piece.

21. The device according to claim 19, wherein the protuberant part (120) is a cylindrical pin and the groove (105) is a semi-cylindrical groove adapted to tightly receive said pin.

22. The device according to claim 19, wherein the cartridge and the receptacle are engaged by resting the protuberant part (120) on the edge of the groove (105) and movement of the cartridge to contact the stud with the plug causes the protuberant part to roll in to the center of the groove.

23. The device according to claim 1, wherein the contact surfaces of the plug and the stud are self cleaned during engagement of the cartridge in the receptacle.

24. The device of claim 1, wherein said receptacle being suspended in said box engages said absorber according to a movement of said hood.

25. The device according to claim 1, wherein the return force for the plugs (10) by the cushioning means (11) is about 1 N for each plug.

26. The device according to claim 24, further comprising a means for automatically cutting the electrical power supply to the cartridge when hood (70) is open.

27. The device according to claim 26, wherein the means for cutting the power supply comprises an opening detection contact means mounted on the hood (70) and on a portion of the box that contacts the hood and contains the receptacle (30).

28. A data storage or recording device for a severe environment comprising a cartridge (40) and a suspended receptacle (30), wherein the cartridge and receptacle are electrically connected by the cooperation of a plug (10) mounted elastically on the receptacle (30) and a stud (12, 16, or 18) hermetically mounted on the cartridge (40) said plug (10) and said stud (12, 16, or 18) connected by contact and not by insertion, wherein the connection between cartridge (40) and receptacle (30) is made by a plurality of pairs of plugs (10) and studs (12, 16, or 18);

said plugs (10) extending through the wall of the of the receptacle (30) and presenting a protuberant portion having a rounded shape;

said plugs being mounted on a shock absorption and return means (11);

said studs (12, 16, or 18) protruding through the walls of the cartridge (40) and presenting a slightly protuberant part;

said cartridge (40) and said receptacle (30) further comprising engagement means capable of positioning said plugs (10) and said studs (12, 16, 18) opposite each other so as to make an effective electrical contact and to ensure the mechanical hold of the cartridge (40) in the receptacle (30);

said plugs (10) and said studs (12, 16, or 18) generically adapted to cooperate and create an effective electrical contact when the receptacle (30) and cartridge (40) are engaged with one another; and wherein opening a hood (70) disengages a shock absorber (300) by engaging a means for temporarily and automatically locking the movement of the receptacle (30).

29. The device of claim 28, wherein each plug and stud pair corresponds to one electrical contact between the cartridge and the receptacle.

30. The device of claim 28, wherein the studs have a shape selected from concave, planar and convex.

31. A process for hermetically connecting a data recording and storage cartridge (40) and a receptacle (30) for use in a severe environment, comprising contacting, without inserting a plug (10) mounted elastically on the receptacle (30) with a stud (12, 16, or 18) hermetically sealed on the cartridge (40) to form an electrical connection between said stud and said plug, wherein said receptacle (30) disengages a shock absorber (300) when a hood (70) is opened by engaging a means for temporarily and automatically locking the movement of the receptacle (30).

32. The process according to claim 31, wherein the rod (45) of the stud is mounted and positioned in an opening in a wall of the cartridge (40) by glass welding (4).

33. The process of claim 31, wherein a mold of protective material (60) is deposited around a head (46) of the stud.

34. The process of claim 33, wherein the protective material comprises a resin.

35. The process of claim 31, wherein the contact is made during an engagement of the cartridge (40) into the receptacle (30).

36. The process according to claim 35, wherein the engagement comprises slidingly engaging a clip (100) comprising a groove (105) integral with the cartridge (40) into a U-shaped opening of an engagement piece (110, 140) of the receptacle (30), said engagement piece comprising a protuberant part (120), descendingly engaging the groove (105) to a position slightly askew of the protuberant part (120), positioning a contact face of the cartridge (40) with a contact face of the receptacle (30), and tightly fitting the protuberant part (120) into the groove (105).

37. The process according to claim 36, wherein the protuberant part (120) rests on an edge of the groove (105) after positioning the contact face of the cartridge (40) with the contact face of the receptacle (30), and the contacting of said stud and said plug causes the pin to roll in the center of the groove.

38. The process according to claim 36, wherein the engagement results in a self-cleaning of the surfaces of the pug and the stud.

* * * * *